United States Patent [19]

Kajino

[11] Patent Number: 4,458,498

[45] Date of Patent: Jul. 10, 1984

[54] METHOD OF AND APPARATUS FOR AMPLIFYING HEAT

[76] Inventor: Yukio Kajino, 16-4, Naka Miyachi, Chichibu-shi, Saitama-ken, 368, Japan

[21] Appl. No.: 401,702

[22] Filed: Jul. 26, 1982

Related U.S. Application Data

[63] Continuation of Ser. No. 230,951, filed as PCT JP80/00117, May 30, 1980, published as WO80/02738, Dec. 11, 1980, § 102(e) date Jan. 9, 1981, abandoned.

[30] Foreign Application Priority Data

Jun. 4, 1980 [JP] Japan ..... 54-69676

[51] Int. Cl.[3] ..... F25B 27/00

[52] U.S. Cl. ..... 62/79; 62/238.6; 165/29; 237/2 B

[58] Field of Search ..... 62/79, 179, 175, 324.1, 62/324.6, 513, 335, 430, 238.7, 238.6; 237/2 B; 165/29, 45

[56] References Cited

U.S. PATENT DOCUMENTS 2,468,626 4/1949 Graham ..... 165/29
3,984,050 10/1976 Gustafsson ..... 62/238.6

FOREIGN PATENT DOCUMENTS 47-18624 6/1972 Japan .
48-10337 4/1973 Japan .
1490202 10/1974 United Kingdom .

*Primary Examiner*—Albert J. Makay
*Assistant Examiner*—Harry Tanner
*Attorney, Agent, or Firm*—Armstrong, Nikaido, Marmelstein & Kubovcik

[57] ABSTRACT

A method and apparatus, wherein heat is absorbed from a first heat medium in a heat source circulating circuit, by way of an evaporator, discharge of heat in a condenser from a second heat medium rendered to a high pressure and high temperature state in a compressor is restricted in a heat pump circuit to maintain the temperature for the heat medium recycled from the condenser to the evaporator at a relatively high set temperature and, while on the other hand, the remaining amount of the heat discharged from the condenser in the heat pump circuit is absorbed and accumulated through a heat medium circulating circuit through which a third heat medium is circulated and a portion of the heat thus obtained is supplied to the heat medium in the above heat source circuit to maintain the heat medium in the heat source circuit within a range of set temperature higher than the temperature of the heat medium jetted into the evaporator in the above heat pump circuit, to thereby obtain heat at high temperature from the circulating circuit for the third heat medium.

2 Claims, 2 Drawing Figures

METHOD OF AND APPARATUS FOR AMPLIFYING HEAT

This is a continuation of application Ser. No. 230,951, filed Jan. 9, 1981, now abandoned.

DESCRIPTION

1. Technical Field

This invention concerns a method of and an apparatus for amplifying heat based on the known heat pump theory and, more specifically, it relates to a method of and an apparatus for amplifying heat wherein the discharge of heat from a second heat medium in a condenser of a heat pump circuit is restricted to partially retain the heat as it is in the second heat medium thereby recycling the heat medium at a relatively high temperature from the condenser by way of an evaporator to a compressor, while the heat accumulated from the heat discharged in the condenser is partially supplied to a first heat medium which forms a heat source.

2. Background Art

A so-called heat pump system in which the process of the refrigeration system is reversed has been known widely. It has generally been practiced already to utilize the system as a heat source in heating use or the like in the technical field of air conditioning.

As is well-known, the basic principle of the heat pump is to discharge the heat pumped up from a heat source at a lower temperature into a heat utilizing side at a higher temperature thereby transferring the heat from the heat source to the heat utilizing side while maintaining a theoretical heat balance between the amounts of the heat thus pumped up and discharged.

More specifically in FIG. 1 wherein the outline of a conventional heat pump system is shown, a heat pump circuit generally represented by the reference A comprises an evaporator 1, a compressor 2, a condenser 3, a liquid receiver 4, an expansion valve 5 and the like.

Heat medium (such as an underground reservoir of water and atmospheric air, hereinafter referred to as a first heat medium) by heat source 11 is introduced from a pump 12 through pipeway 13 to the primary side of a heat exchanger (not shown) incorporated into the evaporator 1. The temperature of the first heat medium is lowered through heat exchange and the medium is then discharged through a pipeway 14.

While on the other hand, coolant (for example, Freon R 22, hereinafter referred to as a second heat medium) recycled through the heat pump circuit A enters from the expansion valve 5 into the secondary side of the heat exchanger in the evaporator, where it absorbs heat from the first heat medium (for example, about at 16° C.) through heat exchange, and is then supplied through a low pressure circuit 6 to the compressor 2. The secondary heat medium raised to a high pressure and high temperature due to compression at a predetermined compression ratio is introduced through a super high pressure circuit 7 to the primary side of a heat exchanger (not shown) in the condenser 3, where it is condensed through heat exchange, and is then recycled from the liquid receiver 4 through a circuit 8 by way of the expansion valve 5 into the evaporator.

While on the other hand, in a heat utilizing circuit represented by the reference C, water is circulated as a heat medium for heating use (hereinafter referred to as a third heat medium) by a pump 9 through the secondary side of the heat exchanger in the condenser 3 and through heat generation units 10, absorbs heat from the second heat medium at high temperature in the condenser 3 and discharges it in the heat generation units 10.

Thus, heating is conducted by the so-called heat pump system in the circuit shown in FIG. 1, wherein the heat possessed in the first heat medium is transferred by way of the second heat medium to the third heat medium.

While the efficiency of such a heat pump apparatus is generally limited by the temperature of the heat source, heat exchange efficiency and the efficiency of the compressor, all of these efficiencies are greatly dependent on the temperature for the heat source and that for the coolant heat exchanged therewith. In this system, however, since almost all of the heat in the second heat medium supplied from the compressor 2 is absorbed in the third heat medium, the temperature of the second heat medium recycled to the evaporator through the heat pump cycle is relatively low, at which the performance of the compressor can not be utilized effectively. In addition, since an underground reservoir of water also at a relatively low temperature is used at the first heat medium, the temperature difference relative to the required heating temperature of the third heat medium is large, which reduces the efficiency of the compressor or the like as described above and makes it impossible to obtain satisfactory heat pump effects.

It is an object of this invention to overcome the foregoing disadvantages in the prior art and provide a heat amplifying method with excellent efficiency capable of obtaining a great amount of heat at high temperature on the heat utilizing side by utilizing the heat pump system.

Another and more specific object of this invention is to provide the above-mentioned heat amplifying method capable of drastically improving the heat pump efficiency by operating a compressor or the like in a heat pump at a high temperature within the highest workable temperature.

A further object of this invention is to provide the above-mentioned heat amplifying method capable of remarkably improving the performance and the efficiency of the compressor by the increase in the temperature of the evaporated coolant to be supplied to the compressor.

A further object of this invention is to provide the above-mentioned heat amplifying method capable of increasing the temperature of the evaporated coolant using no additional external heating source but by partially utilizing the heat in the heat pump circuit per se.

A still further object of this invention is to provide a heat amplifying apparatus utilizing the heat pump system capable of carrying out the foregoing methods.

DISCLOSURE OF INVENTION

According to this invention, taking notice of the fact that the efficiency of the compressor and the like in a heat pump circuit can be improved by raising the temperature of the heat medium supplied thereto, discharge of heat from a second heat medium in the condenser of the heat pump circuit is restricted to partially retain the heat as it is in the second heat medium thereby recycling the heat medium at a relatively high temperature from the condenser by way of the evaporator to the compressor, while the heat accumulated from the condenser into a third heat medium in a heat utilizing circuit is partially fed to the first heat medium in order that the temperature for the first heat medium in the heat source circuit is made higher than that for the second heat medium at a relatively high temperature recycled to the evaporator, whereby the efficiency of the heat pump can significantly be improved by repeatingly recycling each of the heat mediums in each of their circuits under such a system and the heat can be taken out on the side of the heat utilizing units in much greater amount and at higher temperature as compared with the conventional heat pump system.

The principle of this invention is summarized more in detail and more specifically as follows:

(a) The basic constitution of this invention utilizes the known theory of the heat pump in which the heat from a heat source is transferred to a heat utilizing side by way of a recycling circuit comprising an evaporator, a compressor, a condenser and an expansion valve (capillary tube).

(b) The temperature of the coolant in the route from the exhausting side of the compressor to the evaporator in the heat pump circuit: compressor-condenser-liquid receiver-expansion valve (hereinafter referred to as a high pressure circuit) is maintained as high as possible. Although it has been considered desirable in the conventional heat pump to discharge heat as much as possible from the heat medium in the condenser for improving the pump efficiency, the principal feature of this invention is to restrict the amount of heat discharged in the condenser as low as possible to maintain the temperature of the heat medium jetted out from the expansion valve of the capillary to the evaporator at a relatively high set temperature.

(c) Since the temperature of the coolant exhausted to the side of a super high pressure circuit from the compressor to the condenser is determined by the temperature of the coolant in a low pressure circuit supplied from the evaporator to the compressor and the efficiency of the compressor is improved depending on the temperature, the temperature of the coolant in the low pressure circuit is set as high as possible. An upper limit is, however, imposed to the set value considering the output power of the compressor and the heat resistant temperature of lubricants used therein so that the function of the compressor may not be impaired.

(d) Since the temperature for the coolant fed to the evaporator is thus set relatively high, the temperature of the heat source (substance to be cooled) is maintained higher than it to such an extent as enabling heat exchange in the evaporator. For this purpose, heat discharged from the condenser to the third heat medium is partially fed back to the coolant sent from the heat source to the evaporator.

Thus, the feature of this invention resides in that a portion of the heat on the side of the condenser in the heat pump is recycled as it is in the heat pump circuit to maintain the temperature of the coolant supplied to the compressor at a relatively high temperature and, while on the other hand, the heat discharged from the condenser to the heat utilizing side is successively accumulated and fed back to the heat source to thereby enable heat exchange in the evaporator relative to the above coolant set at a relatively high temperature in the heat pump circuit at least upon starting of the operation.

This invention comprises at least the following four necessary factors in order to realize the foregoing features of this invention:

(1) The flow rate of the coolant on the side of the heat utilizing units in the condenser is set higher than the flow rate for the coolant on the side of the heat source in the evaporator so as to make a difference between the heat exchange efficiencies in the condenser and in the evaporator, in order to partially feed back the heat from the condenser to the compressor which is one of the principal features of this invention.

(2) The temperature of the coolant on the side of the heat source is set higher than the temperature of the coolant in the evaporator of the heat pump circuit in order to enable heat exchange relative to the coolant in the heat pump circuit which has been raised to high temperature by the feed back of the heat.

(3) Specifically, the heat in the coolant on the side of the heat utilizing units in the condenser is fed back to the coolant on the side of the heat source for the above purpose.

(4) The operation of the compressor is adapted to be interrupted automatically if the temperature or the pressure in the route between the compressor and the condenser (hereinafter referred to as a super high pressure circuit) should increase beyond predetermined values so that the function of the compressor may not be impaired by the high temperature or the high pressure.

BEST MODE FOR CARRYING OUT THE INVENTION

Figure 1:
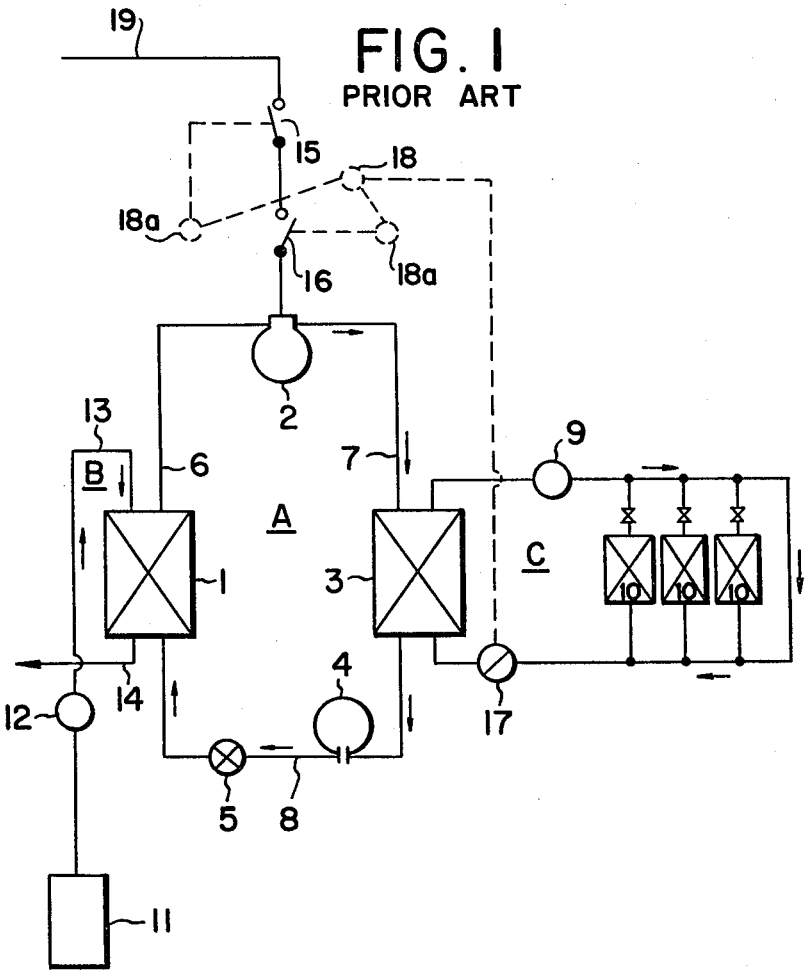
FIG. 1 PRIOR ART
FIG. 1 is a schematic circuit diagram for a conventional heat pump system.
Figure 2:
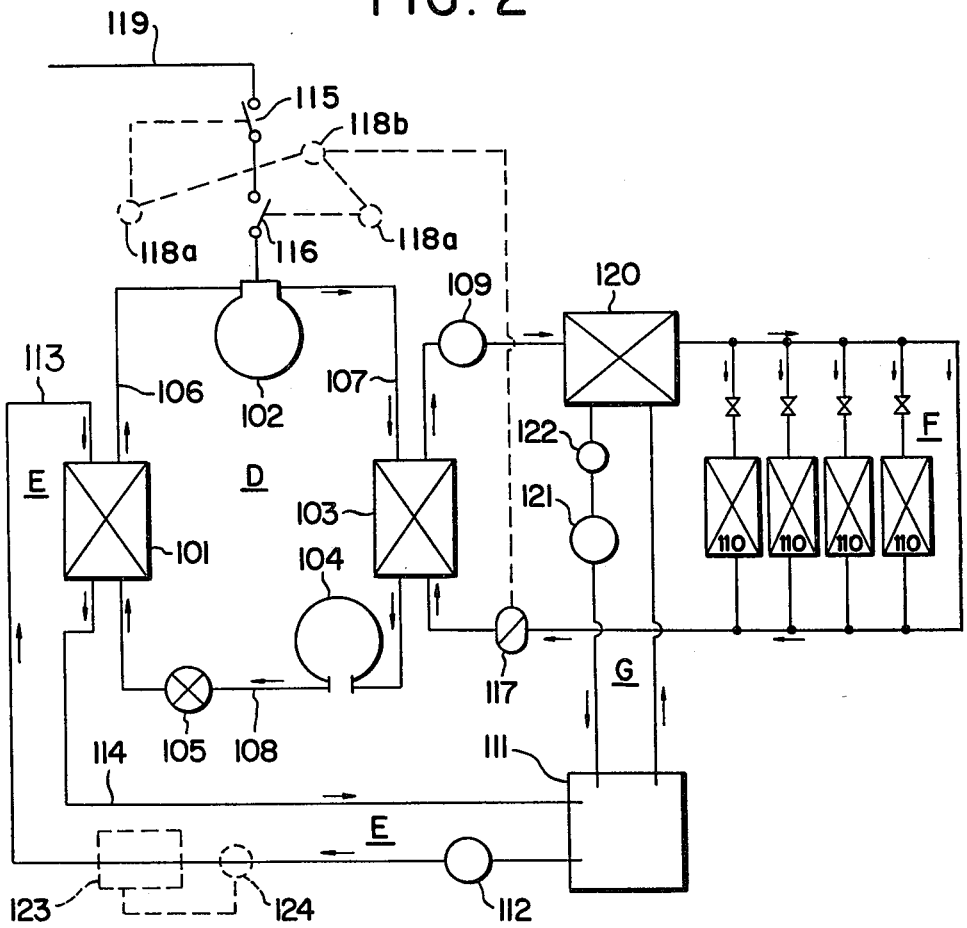
FIG. 2 is a schematic circuit diagram for the heat amplifying apparatus of this invention.

FIG. 2 shows a coolant recycling circuit of a heat amplifying apparatus for practicing the method of this invention, in which a heat pump circuit D contained in the circuit is constituted basically in the same manner as in the circuit A shown in FIG. 1.

Specifically, a preferred embodiment according to this invention comprises an evaporator 101, a compressor 102, a condenser 103, a liquid receiver 104, an expansion valve 105 and the like, in which a heat source circulating circuit E for a first heat medium is provided on the primary side of a heat exhanger in the evaporator 101 and a heat utilizing circulating circuit F for a third heat medium circulated by a pump 109 through heat generation units is provided on the secondary side of a heat exchanger in the condenser 103 respectively.

In this embodiment, the heat exchange efficiency of the heat exchanger in the condenser 103 is restricted to a predetermined value in order to maintain the second heat medium recycled to the evaporator 101 at a relatively high predetermined temperature by the restriction of heat transfer to the third heat medium from the second heat medium which is supplied from the compressor 102 to the condenser 103. Specifically, the efficiency in the heat exchange can be controlled with ease by adjusting the flow rate of the third heat medium on the secondary side of the heat exchanger (on the side of the heat utilizing circuit F) relative to the flow rate of the second heat medium on the primary side of the heat exchanger by properly setting the revolutional speed of the pump 109, as well as the flow amount of the expansion valve 105.

Since the temperature of the second heat medium compressed by the compressor 102 on the side of the super high pressure circuit 107 is determined as: compression ratio of the compressor 102×temperature of the evaporated heat medium on the side of the low pressure circuit 106, and the efficiency of the compressor is improved along with the temperature of the heat medium, it is theoretically preferred to set the temperature of the second heat medium exhausted to the high pressure circuit 108 as high as possible by limiting the heat exchange efficiency in the condenser 103 as low as possible. The temperature on the side of the super high pressure circuit has, however, an actual upper limit depending on the output power of the compressor 102 and on the heat resistant temperature of lubricants employed (legal regulations are also imposed). The heat pump has, therefore, to be operated within such a range of temperature as not exceeding the above upper limit. In view of the above, in this embodiment, a low pressure circuit breaker 115 and a high pressure circuit breaker 116 are provided respectively on the sides of the low pressure circuit 106 and of the super high pressure circuit 107 for the compressor 102 in the heat pump circuit D. Each of the breakers is designed to be controlled by electric switches 118*a* actuated by the temperature-sensing output of a thermo-sensor 117 disposed in the heat utilizing circuit F, such that the switches 118*a* are actuated by the thermo-sensor 117 when it detects a temperature exceeding the predetermined upper level thereby opening the circuit breakers 115,116 to disconnect the compressor 102 from the heat pump circuit D and automatically interrupting its operation. In the drawing, 119 represents an electric power source circuit and arrows in the drawing represent the circulating direction for each of the heat mediums respectively.

In this embodiment, since the temperature of the second heat medium exhausted from the condenser 103 is maintained at a relatively high temperature, it is necessary that the temperature for the first heat medium to be heat-exchanged therewith is maintained at a higher temperature for enabling predetermined heat exchange.

In order to secure such a temperature difference between the first heat medium and the second heat medium mentioned above, the heat possessed in the third heat medium at high temperature in the heat utilizing circuit F is partially fed back so as to utilize it as a heat source for the first heat medium in this embodiment. Specifically, a heat exchanger 120 whose primary circuit forms the flowing path of the third heat medium is provided in the circuit F, and the secondary circuit G thereof is connected by way of a pump 121 to a heat source 111 for the first heat medium. In the drawing, 122 represents a temperature sensor for the on-off of the feed back circuit G. The temperature for the first heat medium may be set so that it has a temperature difference to the second heat medium at a relatively high temperature for enabling predetermined heat exchange. It is set by controlling the operation of the pump 121 for recycling the first heat medium in the secondary circuit (heat supply circuit G) to the heat exchanger 120 by a temperature sensor 122.

In the case where underground reservoir of water is used, for example, as the first heat medium as in the case of the conventional heat pump shown in FIG. 1, the underground reservoir of water whose heat has been transferred to the second heat medium through the heat exchange is drained as it is. But, in the present embodiment, the first heat medium from the heat source 111 is cyclically used in a closed circuit E and always kept at a temperature with a predetermined difference to the second heat medium by being heated with the heat fed back partially from the third heat medium through the feed back circuit G.

Upon starting the heat pump circuit, for example, in extremely cold seasons, it may be expected such a case where the temperature of the first heat medium is lower than that of the second heat medium and also such a case where the smooth flow of the first heat medium is hindered by refrigeration. In such cases, the temperature for the first heat medium has to be raised previously by some adequate means upon starting operation.

Therefore, in the present embodiment, an auxiliary heater 123 and a thermo-sensitive switch 124 are provided on the high temperature side of the circuit E for supplying the first heat medium from the above heat source 111. The thermo-sensitive switch is actuated to operate the auxiliary heater when the temperature of the first heat medium in the circuit E is lower than a predetermined temperature upon starting of the operations.

The operation of the embodiment according to this invention having the foregoing constitution in FIG. 2 is to be explained.

Upon starting the heat pump, the first heat medium from the heat source 111 is circulated by the pump 112 from the circuit E and through the primary side of the heat exchanger in the evaporator 101. While on the other hand, the second heat medium recycled through the heat pump circuit D passes through the secondary side of the heat exchanger in the evaporator 101, where it absorbs the heat from the first heat medium through heat exchange therewith, then is sent through the low pressure circuit 106 to the compressor 102 and compressed to a high temperature and high pressure. The second heat medium is sent through the super high pressure circuit 107 to the primary side of the heat exchanger in the condenser 103 where heat is exchanged with the third heat medium in the heat generation circuit F circulating through the secondary side. In the present embodiment, however, the portion of the heat absorbed from the first heat medium to the second heat medium, that is necessary for maintaining the second heat medium at the predetermined set temperature is, not heat-exchanged but retained as it is in the second heat medium, which is then recycled through the liquid receiver 104 and the expansion valve 105 to the evaporator 101 in the heat pump circuit D.

Meanwhile, although the balance of the heat other than that retained in the second heat medium in the above heat exchange with the second heat medium is transferred to the third heat medium, it is not directly discharged in the heat generation units 110 but fed back from the heat exchanger 120 by way of the feed back circuit G to the first heat medium to be used for increasing the temperature of the first heat medium to a predetermined temperature difference relative to the second heat medium. This raises the temperature of the circuit for supplying the first heat medium and the like, by which heat exchange with the second heat medium in the evaporator 101 is increased to raise the average temperature in the heat pump circuit D. As the result, the heat transferred from the condenser 103 to the third heat medium in the heat utilizing circuit F is also increased. That is, since it is adapted as a recycling system, the third heat medium can be raised theoretically to a temperature comparable with the high temperature generated in the super high pressure circuit 6 between the compressor 2 and the condenser 5 in the heat pump circuit A by repeating the operation of recycling the absorbed heat and then absorbing it. Then, when the temperature of the second heat medium is raised to the predetermined set temperature and the temperature of the first heat medium also reaches the predetermined level, the temperature-sensor 122 (thermostat switch) detects it and interrupts the circulation in the feed back circuit G on the secondary side of the heat exchanger 120. Accordingly, the heat transferred from the second heat medium to the third heat medium in the condenser 103 is totally discharged thereafter in the heat generation units 110 for the utilization of heat.

If the temperature for the second heat medium exhausted from the compressor 102 exceeds a predetermined upper level, the thermo-sensitive switch 117 detects it and actuates the switches 118*a*, 118*b* to open the circuit breakers 115, 116 in the low pressure and the high pressure circuits to disconnect the compressor 102 from the heat pump circuit D, as well as interrupt its operation.

If the temperature for the first heat medium is lower than that for the second heat medium due to the extremely low atmospheric temperature, etc. upon starting of the heat pump circuit, the thermo-sensitive switch 124 in the circuit for supplying the first heat medium detects it and operates the auxiliary heater 123 to raise the temperature of the first heat medium to such a temperature capable of starting the heat pump.

Considerations are to be made on the temperature for each of the heat mediums suitable to the most effective operation of the heat pump in the present embodiment.

At first, the temperature for the third heat medium in the heat utilizing circuit F is, desirably, as high as possible but the upper limit thereof is actually about 55° C. being restricted as foregoings by the output power of the compressor 102 and the heat resistance of the lubricants. Then, the temperature fed back and supplied from the third heat medium in the heat utilizing circuit F to the first heat medium in the heat source circuit E is, actually, determined as about 20° C. considering the performance of the compressor 102 and the like. Specifically, since the upper limit of the temperature set for the third heat medium is 55° C., the temperature for the second heat medium supplied to the evaporator 101 is preferably about 12°–14° C. and the temperature for the first heat medium for the effective heat exchange therewith is about 20° C. as foregoings, although it somewhat depends on the flow rate. The heat exchange between the second heat medium and the third heat medium in the condenser 103 is conducted for the heat corresponding to about 1°–2° C. in temperature difference, because it is required to leave such an amount of heat in the second heat medium as to maintain a predetermined set temperature at the inlet of the evaporator 101. Such a heat exchange can be conducted by setting the flow rate (flow amount) of the third heat medium passing through the condenser 103 much higher than the flow rate (flow amount) of the first heat medium passing through the evaporator 101. In this way, since the heat utilizing circuit F through which the third heat medium passes is designed as an endless recycling system, the third heat medium passing through a particular location (flow area) can absorb, in one cycle, the heat for 1° C.–2° C. which is the heat exchanging temperature described above. Accordingly, the period of time required for raising to a desired temperature can be determined with ease based on the total amount and the flow rate or the flow speed of the third heat medium in the circuit F assuming that there are no heat losses at all in the heat utilizing circuit F neglecting the natural losses of the heat in the heat utilizing circuit F.

Although liquid such as water is used as the first or the third heat medium in the present embodiment, other liquids may be used as the heat medium and, further, fluids in a wider sense including gases or viscous fluids can also be used. It is further possible to use those solid mediums such as highly heat conductive metals as the heat medium. In these cases, the circuit components such as heat conduction pipes can be saved depending on the types of the heat medium. It may some time to be desirable, in the case where the metal medium is employed as the main heat medium, to use an intermediate medium in combination for transferring the heat between the heat source and the heat utilizing units.

In any of the foregoing cases, however, the fundamental system for the heat pump circuit and the like is substantially the same as that described in the foregoing embodiment aside from the details thereof.

INDUSTRIAL APPLICABILITY

As stated above, according to this invention, a great amount of heat at much higher temperature that could not be obtained so far in the conventional heat pump systems can be obtained, by the quite novel method and apparatus of partially feeding back the heat from the condenser to the evaporator, which goes beyond the concept of the conventional heat pump system that the heat balance should be maintained between the heat absorption and heat discharge in the evaporator and the condenser in the heat pump circuit, that is, the heat pumped up by the evaporator from the heat source is completely be taken out through the condenser to the heat utilizing units. As the result, the electrical energy cost required for obtaining a certain amount of heat energy can be decreased to about 1/20 to that in electrical heating, to about ¼ to that in conventional heat pump and to about 1/7 to that in petroleum fuel (based on the fuel cost in Japan in 1979).

What is claimed is:

1. A method of amplifying heat comprising:

transferring heat from a first heat source circuit (E) to a second heat medium recycled through a recycling type heat pump circit (D) in an evaporator and raising said second heat medium to a high pressure and high temperature by a compressor, restricting heat discharge from said second heat medium at the high pressure and high temperature in a condenser of said heat pump circuit (D) to maintain the temperature of said second heat medium jetted out through an expansion valve to said evaporator at a relatively high set temperature depending on the performance of said compressor, transferring the heat other than that used for maintaining said second heat medium at said set temperature from the condenser to a third heat medium by way of a heat utilizing circuit (F) and circulating said third heat medium in said heat utilizing circuit (F) to said condenser, thereby successively accumulating heat therein to a predetermined safety temperature, feeding back a portion of the heat in said third heat medium accumulated in said heat utilizing circuit (F) to said first heat medium in said heat source circuit (E), thereby increasing the temperature of said first heat medium to a predetermined temperature higher than the temperature of the second heat medium jetted into the evaporator in the heat pump circuit, and stopping the compressor whenever the temperature of the third heat medium reaches a predetermined value and actuating the compressor when it decreases below said predetermined value.

2. The method of amplifying heat as described in claim 1, further comprising, at the start of the hear pump circuit (D), if the temperature of the first heat medium in the heat source circuit (E) is lower than a further predetermined temperature, additionally heating said first heat medium so that the temperature thereof is higher than the temperature of said second heat medium jetted into the evaporator.

* * * * *